United States Patent [19]

Zeligman et al.

[11] 4,275,512

[45] Jun. 30, 1981

[54] SANDAL STRUCTURE

[75] Inventors: Robert Zeligman; John R. Zengerle, both of Tucson, Ariz.

[73] Assignee: Frontier Footwear Corporation, Tucson, Ariz.

[21] Appl. No.: 87,418

[22] Filed: Oct. 22, 1979

[51] Int. Cl.[3] ..... A43D 9/00; A43B 3/12

[52] U.S. Cl. ..... 36/11.5; 36/43; 36/32 R; 36/30 R; 12/142 S

[58] Field of Search ..... 36/11.5, 43, 44, 32 R, 36/30 R; 12/142 S

[56] References Cited

U.S. PATENT DOCUMENTS

| | | | |
|---|---|---|---|
| 2,220,534 | 11/1940 | McLean | 36/11.5 |
| 2,254,184 | 8/1941 | Mayer | 36/11.5 |
| 4,172,330 | 10/1979 | Kao | 36/11.5 |

*Primary Examiner*—Patrick D. Lawson

*Attorney, Agent, or Firm*—Cahill, Sutton and Thomas

[57] ABSTRACT

A durable sandal includes a composition rubber sole, a first composition rubber insole, and a unitary leather element including four straps and a second insole section of substantially the same shape as the first insole. Two of the straps having buckles attached thereto are substantially shorter than the other two and extend from one edge of the second insole section. The other two straps extend from an opposite edge of the second insole section. The unitary leather element is aligned with and peripherally sewn to the top surface of first composition rubber insole. The bottom surface of the composition rubber insole is adhesively bonded to an upper surface of the composition rubber sole.

5 Claims, 10 Drawing Figures

SANDAL STRUCTURE

BACKGROUND OF THE INVENTION

1. Field of the Invention

The invention relates to sandal structures and methods of making sandals.

2. Description of the Prior Art

Sandals are widely used by men, woman and children throughout the world. There are a wide variety of sandal structures which are suitable for various manufacturing techniques or for being handmade. Sandals are also widely used in the United States, especially by women and children. Children's sandals need to be especially durable in order to withstand the rough treatment which they receive from most children.

The shoe manufacturing industry throughout the United States, Europe and the Far East, is highly competitive. The sandal segment of the shoe industry is no different in this respect than the rest of the shoe industry. The shoe manufacturing industry in the United States has experienced a marked decline in recent years, due to high labor costs and high costs of manufacturing equipment and machinery. Because labor costs are much lower, less expensive shoe manufacturing machinery is required for overseas shoe manufacturing operations. Consequently, most shoes now sold in the United States are manufactured overseas.

Present sandals have structures which necessitate use of a relatively large amount of hand labor or use of very complex and extensive automatic manufacturing equipment for making such sandals. One common sandal structure includes a composition rubber sole to which a leather insole is adhesively bonded. The leather insole includes a plurality of elongated rectangular slots extending through the insole along the major edges of the insole. Toe straps and ankle straps having enlarged ends for the upper portion of the sandal. The enlarged ends of the toe straps and ankle straps are inserted through the elongated slots and are bent inwardly against the lower surface of the insole before the resulting assembly is adhesively bonded to the upper surface of the composition rubber sole. Ordinary buckles are utilized to fasten opposing toe straps and ankle straps. The above described sandal structure is widely used, but has a number of shortcomings. One of the most serious shortcomings of the foregoing sandal structure is that the enlarged ends of the respective straps are often loosened or pulled out of the slots when the sandal is subjected to rough treatment, as by active children. If even one enlarged end of a sandal is pulled loose in this manner the sandal and its mate are, for all practical purposes useless, since repair of the sandal structure is impractical. Although adhesive bonding between the insole and sole is economical and relatively durable, such bonding tends to gradually weaken because ordinary wear, especially in children's sandals produces great stresses at the edges of the bonding, thereby separating the bond at the edges of the sandals. The ordinary wear stresses then cause the separation to gradually spread inward, until the tabs become loosened. There is clearly an unmet need for an improved, low cost sandal having straps which do not become loosened by rough treatment.

Accordingly, it is an object of the invention to provide an improved sandal having straps which do not become loosened as a result of rough treatment received from wearers, especially children.

Another shortcoming of the above described sandal structure is that the described tabs extend between the insole lower surface and the upper surface of the composition rubber sole, thereby producing bumps which are often uncomfortable to the wearer.

Accordingly, another object of the invention is to provide an improved sandal which does not have bumps along the edges of its insole.

The above described sandal structure requires use of expensive machinery in order to cut the leather strap sections. The sandal structure requires individual strap sections, which are punched from a piece of leather by utilizing powerful, expensive punches. The necessity of providing a number of individual straps increases the cost of such equipment. The necessity of punching the elongated slots in the insole necessitates use of more expensive machinery and labor than would be necessary if the slots were not required. Expensive, complicated machinery is also required to accomplish the task of inserting the enlarged ends of the straps into the slots of the insole prior to adhesively bonding the insole and strap assembly to the composition rubber sole. Thus, there is an unmet need for a sandal having a structure capable of being manufactured with less complex and expensive machinery, less labor, and fewer complex manufacturing steps than the above described sandal.

Accordingly, another object of the invention is to provide an improved sandal having a structure which is more easily and less expensively manufactured than sandal structures of the prior art.

Still another object of the invention is to provide an improved method of manufacturing sandals.

Yet another object of the invention is to provide a sandal structure and method of making which overcomes the above described shortcomings of the prior art.

SUMMARY OF THE INVENTION

Briefly described, and in accordance with one embodiment thereof, the invention provides a sandal having a sole piece and an upper insole piece having a plurality of straps integral with the upper insole piece. In the described embodiment of the invention, the upper insole piece is sewn to a lower insole piece by means of continuous sewn stitching disposed along the periphery of the lower insole piece. The sole piece is composed of composition rubber material. The lower insole piece is also composed of composition rubber, and is adhesively bonded to the upper surface of the sole piece. The upper sole piece is composed of leather. The sandal is manufactured by punching the upper insole piece from a piece of suitable leather. The lower insole piece is formed by punching it from a sheet of composition rubber material. The lower surface of the upper insole piece is aligned with the upper surface of the lower insole piece, and a sewing machine is utilized to sew the periphery of the lower insole piece to the upper insole piece. Buckles are attached to appropriate ones of the straps. Cement is applied to the lower surface of the lower insole and the upper surface of the sole piece and allowed to cure for a predetermined amount of time. The cemented surfaces are passed beneath an infrared heat source, heating them to a predetermined temperature. The lower surface of the lower insole and the upper surface of the sole piece are aligned and pressed together for a predetermined amount of time utilizing a predetermined amount of pressure.

DESCRIPTION OF THE INVENTION

Figure 1:
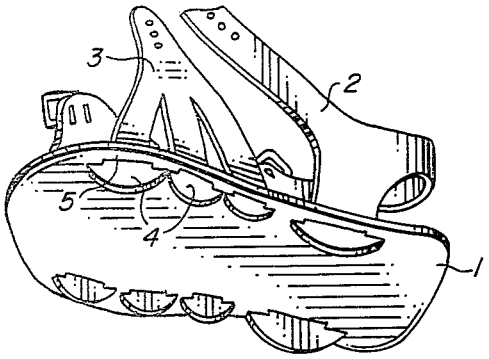
FIG. 1 (PRIOR ART)
FIG. 1 is a perspective view showing part of a prior art sandal structure.

Referring now to the drawings, FIG. 1 shows the strap and insole configuration of the previously mentioned prior art structure, including a leather insole 1, ankle strap 2, toe strap 3, a plurality of elongated slots 5 in insole 1, and a plurality of enlarged ends of the ankle and toe straps. Enlarged ends 4 extend through slots 5, as previously mentioned, and are folded inward before cementing the structure of FIG. 1 to a composition rubber sole (not shown). As previously mentioned, enlarged heads 4 are often pulled loose when the sandal is subjected to rough treatment.

Figure 8:
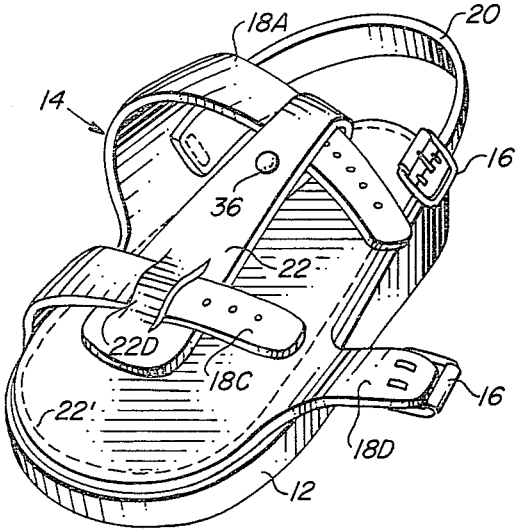
FIG. 8 is a perspective view of the structure of FIG. 7 after attachment of a T-strap.

Referring now to FIG. 8, a completed sandal 10 of the present invention is shown. Sandal 10 includes a composition rubber sole 12. Sole 12 can be purchased from American Built-Rite Company, of Massachusetts.

Figure 2:
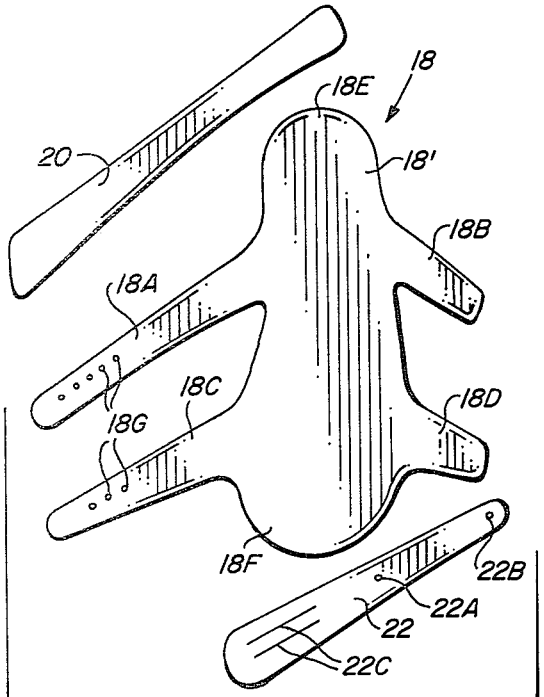
FIG. 2 is a plan view showing the punched leather parts of the sandal of the present invention.

Referring now to FIGS. 2 and 8, sandal 10 includes an upper assembly 14 which includes a leather insole-strap section 18. Referring now to FIG. 2, insole/strap section 18 includes a foot-shaped upper insole section 18' and has a toe portion 18F and heel portion 18E. Upper insole section 18' has integral straps 18A, 18B, 18C, and 18D, which are substantially inclined forward toward toe portion 18F. Straps 18A and 18C are substantially parallel and straps 18B and 18D are substantially parallel. Straps 18A and 18B are referred to as ankle straps, and straps 18C and 18D are referred to as toe straps. A plurality of tongue receiving holes 18G are formed in straps 18A and 18C for effecting clasping with buckles 16, which are attached to straps 18D and 18B.

A heel strap 20 is attached to ankle straps 18A and 18B. A T-strap 22 includes loops through which toe strap 18C and ankle strap 18A extend, as illustrated in FIG. 8.

Figure 3:
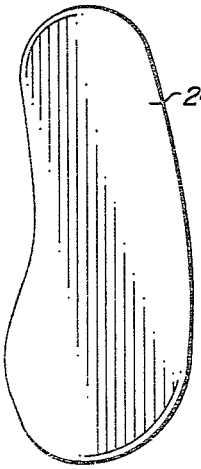
FIG. 3 is a top view of the insole of the sandal of the present invention.
Figure 7:
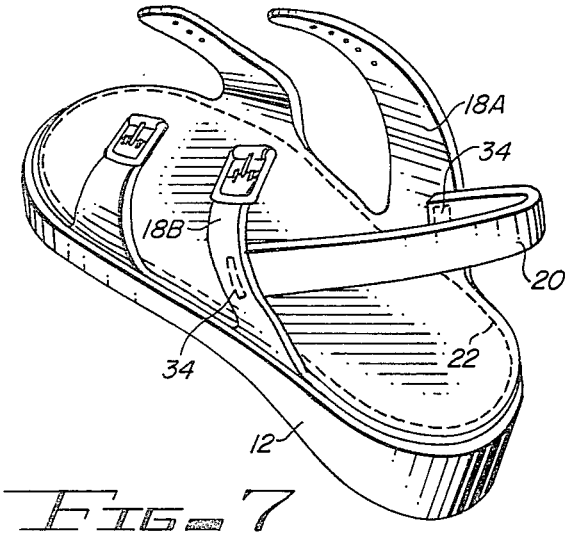
FIG. 7 is a perspective view of the sandal structure of the invention after attachment of a heel strap to the ankle straps.

Although it is not readily apparent from FIG. 8, upper assembly 14 not only includes upper insole section 18' and its integral toe and ankle straps, but also includes a lower insole 24, which is shown in FIG. 3. Lower insole 24 is composed of composition rubber and is formed by being punched from a sheet composition rubber. The periphery of lower insole 24 is approximately coextensive with the periphery of the foot-shaped portion of leather upper insole section 18'. Upper insole section 18' is stitched along its periphery to the periphery of lower composition rubber insole 24. During the manufacturing process, subsequently described, upper assembly 14 is adhesively bonded to the upper surface of composition rubber sole 12.

Figure 10:
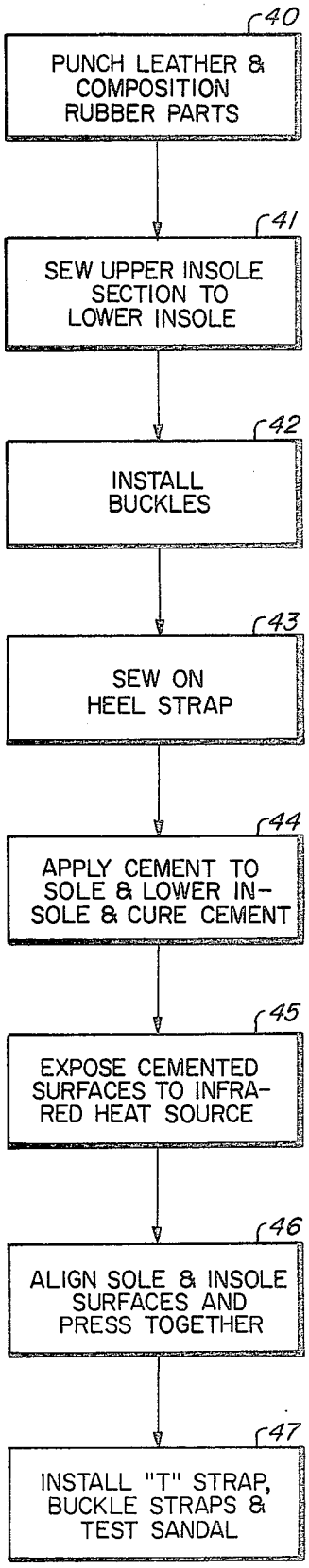
FIG. 10 is a flow chart useful in describing the method of making the sandal of the present invention.

The method of manufacturing sandal 10 is best described by referring to FIGS. 2–8 and to the flow diagram of FIG. 10. As indicated in block 40 of FIG. 10, the first step in the manufacturing process is to punch leather insole/strap section 18, heel strap 20, and T-strap 22 from a piece of leather. The punching operation can be performed by means of a punch machine referred to in the art as a "clicker" machine. Holes 18G and straps 18A and 18C (for receiving the tongue of buckles 16) hand cuts 22C and hole 22B in T-strap 22 can be punched at the same time that the respective parts are punched. Lower insole 24 (FIG. 3) is also punched from a sheet of the above mentioned composition rubber material.

Figure 4:
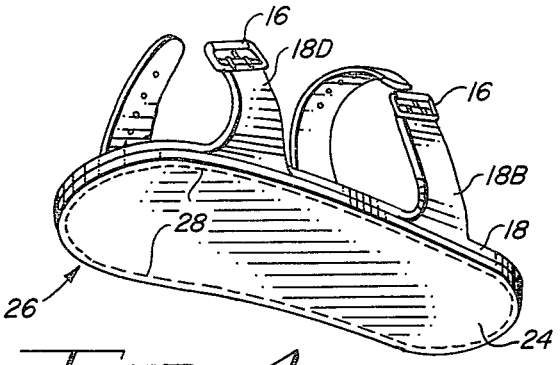
FIG. 4 is a partial perspective view illustrating attachment of the unitary upper insole of FIG. 2 to the lower composition rubber insole of FIG. 3.

Next, the lower surface of upper insole section 18' is aligned with the upper surface of lower insole 24 and is sewn thereto using nylon thread by means of a sewing machine as indicated in block 41 of FIG. 10. Reference numeral 28 in FIG. 4 illustrates the stitching, which is located approximately at one-eighth of an inch from the respective peripheral edges of upper insole section 18' and lower insole 24, as illustrated. The sewing machiene utilized is commonly used in the shoe manufacturing industry, and is manufactured by Singer Sewing Machine Co.

As indicated in block 42, buckles 16 next are attached to the extreme ends of straps 18B and 18D utilizing staples. This step is well known in the shoe manufacturing industry, and is not described in further detail.

Figure 5:
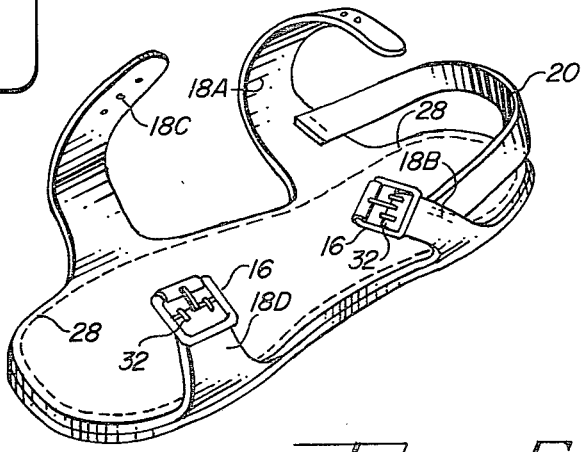
FIG. 5 is a partial plan view of the cement pattern applied to the insole assembly of FIG. 4 and a composition rubber sole.

As indicated in block 43 of FIG. 10, heel strap 20 is then attached, as indicated in FIG. 5.

Figure 6:
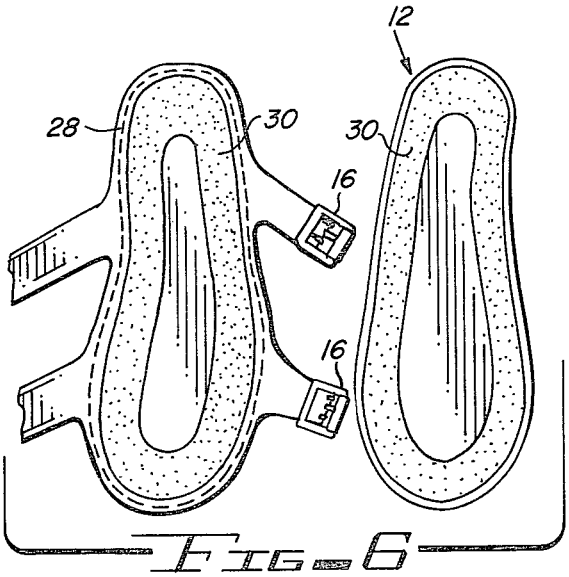
FIG. 6 is a perspective showing the sandal structure after attachment of the insole assembly of FIG. 4 to the composition rubber sole.

As indicated in block 44 of FIG. 10 and also in FIG. 6, the bottom surface of lower insole 24 and the upper surface of composition rubber sole 12 are coated with urethane cement. The cement is allowed to dry for several hours. Next, sole 12 and the upper assembly 14 are placed on a moving conveyor belt which passes through an infrared heat source, which raises the temperature of the cement to approximately 500° F. in approximately thirty seconds.

As indicated in block 46 of FIG. 10, the next step is to align the lower surface of lower insole 24 with the upper surface of sole 12. (Preferably, the top surface of sole 12 has a plurality of cavities therein which produce a cushioning effect on the final product. A circumferential ridge is formed along the upper surface of sole 12. The edges of lower insole 24 set within the ridge, enabling insole 24 to be easily aligned with sole 12 prior to the stamping process). A pressure plate having a shape corresponding to that of lower insole 24 applies approximately 1,000 pounds of pressure for a period of approximately two seconds, thereby adhesively bonding upper assembly 14 to composition rubber sole 12.

Figure 9:
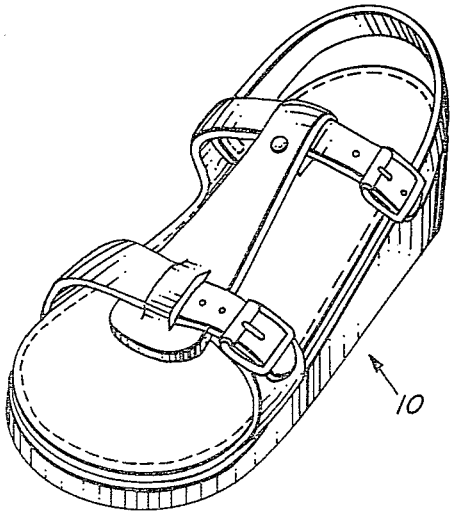
FIG. 9 is a perspective view illustrating the completed sandal structure.

As indicated in block 47 of FIG. 10, the next step is to install T-strap 22 by forming a loop through which ankle strap 18A passes. This is accomplished by means of rivet 36 (see FIG. 8) which passes through holes 22A and 22B in T-strap 22 (see FIG. 2). The final step of the manufacturing process is to fasten the straps utilizing buckles 16 and perform an inspection test by stressing the individual straps and buckles, as indicated in block 47 of FIG. 10. FIG. 9 illustrates the finished product ready for shipment.

The described sandal is far more durable than prior sandals, as the strap has no tendency to become loosened due to rough use because of the integral straps of the upper insole/strap section 18'. The peripheral stitching of upper insole section 18' and lower insole 24 resists periheral separation of upper insole/strap section 18' and lower insole section 24 and reduces edge stress on the cement bond between composition rubber sole 12 and lower insole 24. The sandal of the present invention is substantially less expensive to manufacture than prior art sandals because of its inherent simplicity.

While the invention has been described with reference to a particular embodiment thereof and a particular method of manufacture, those skilled in the art will be able to provide obvious variations in the disclosed structure and method without departing from the true spirit and scope of the present invention. For example, the steps of attaching back strap 20 and buckles 16 can be performed at different points in the manufacturing process described above, as can the step of installing rivet 36 and T-strap 22. If desired, it would be possible to eliminate composition rubber insole 24 altogether and directly bond the lower surface of upper insole section 18 directly to the upper surface of sole 12, although the resulting structure would be less satisfactory than the one described.

We claim:

1. A sandal comprising in combination:

a. a foot-shaped sole, said foot-shaped sole being composed of composition rubber material;

b. a foot-shaped lower insole, said foot-shaped lower insole being substantially thinner than said foot-shaped sole;

c. an upper insole section, said upper insole section having a foot-shaped section and a plurality of straps integral with said foot-shaped section, said straps extending from edges of said foot-shaped section, said upper insole section including four of said straps, first and second ones of said straps each extending from an instep edge of said upper insole section and having first and second buckles attached thereto, said first and second straps being spaced apart, substantially parallel, and inclined substantially forward toward a toe end of said upper insole section when said upper insole section is flat, third and fourth ones of said straps each extending from an edge of said upper insole section opposite to said instep edge and having a plurality of tongue-receiving holes therein for receiving the tongue of a respective one of said buckles, said first buckle being fastened to said fourth strap and said second buckle being fastened to said third strap, said third and fourth straps being spaced apart, substantially parallel, and inclined substantially forward toward the toe end of said upper insole section when said upper insole section is flat;

d. means for attaching the lower surface of said upper insole section to the upper surface of said lower foot-shaped insole, said attaching means including a plurality of stitches extending through said upper insole section and said foot-shaped lower insole, said plurality of stitches being disposed along the entire periphery of said lower foot-shaped insole;

e. means for adhesively bonding the lower surface of said lower foot-shaped insole to the upper surface of said foot-shaped sole; and f. a leather heel strap having opposed ends attached by means of stitches to said second and third straps.

2. The sandal of claim 1 wherein said upper insole section is composed of leather and said lower insole section is composed of composition rubber.

3. The sandal of claim 1 further including adhesive bonding means for adhesively attaching the lower surface of said lower inner sole to the upper surface of said sole.

4. The sandal of claim 6 wherein said sole includes a continuous ridge disposed peripherally along the supper surface of said sole, said lower insole being aligned with said ridge and having an edge surrounded with and adjacent to said ridge.

5. The sandal of claim 1 wherein the upper surface of said foot-shaped sole includes a plurality of cavities therein.

* * * * *